US006383035B1

(12) United States Patent
Kasai

(10) Patent No.: US 6,383,035 B1
(45) Date of Patent: May 7, 2002

(54) ELECTRICAL CONNECTION BOX CONTAINING BUS BARS

(75) Inventor: Koji Kasai, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/714,942

(22) Filed: Nov. 20, 2000

(30) Foreign Application Priority Data

Nov. 18, 1999 (JP) ..... 11-328257

(51) Int. Cl.[7] ..... H01R 11/09
(52) U.S. Cl. ..... 439/724
(58) Field of Search ..... 439/724, 949, 439/404, 76.2, 512

(56) References Cited

U.S. PATENT DOCUMENTS 5,207,587 A * 5/1993 Hamill et al. ..... 439/76.2
5,295,858 A * 3/1994 Kasai et al. ..... 439/404
5,605,465 A * 2/1997 Kobayashi et al. ..... 439/76.2
5,624,280 A 4/1997 Kato
5,626,492 A 5/1997 Onizuka et al.

FOREIGN PATENT DOCUMENTS

| | | |
|---|---|---|
| EP | 0 729 200 A2 | 8/1996 |
| EP | 0 729 200 A3 | 5/1998 |
| GB | 2 293 052 A | 3/1996 |
| JP | 09 261 821 | 3/1997 |

* cited by examiner

*Primary Examiner*—Tulsidas Patel
*Assistant Examiner*—Brian S. Webb
(74) *Attorney, Agent, or Firm*—Oliff & Berridge, PLC

(57) ABSTRACT

An electric connection box, for use in vehicles etc., has vertical parallel bus bars which permit a variety of bus bar circuits to be easily made. The electric connection box has upper and lower casing parts containing the vertical bus bars which may be identical, each having a sheet-form bar body, a plurality of tab terminals, and a plurality of pressure contact blades. At least some of the tab terminals project at regular intervals on one side of the bus bar body and at least some of the pressure contact blades project on the opposite side. To connect the bus bars electrically to form a bus bar circuit, wires are brought into pressure contact with the appropriate pressure contact blades.

11 Claims, 6 Drawing Sheets

ELECTRICAL CONNECTION BOX CONTAINING BUS BARS

BACKGROUND OF THE INVENTION

1. Field of the Invention

The present invention relates to an electrical connection box containing bus bars, suitable for use, for example, in vehicles, such as automobiles. The invention also relates to a method of making such a box.

2. Description of Related Art

An electrical connection box described in U.S. Pat. No. 5,624,280, corresponding to Japanese Laid-Open Patent Application No. 7-135717, is a branched connection box, having an upper case part and a lower case part that are connected to each other, and a plurality of parallel vertical bus bars accommodated in the cases. These vertical bus bars are equipped with a plurality of terminals (tab terminals) projecting upwardly and downwardly in the box. The tab terminals project through the case into connector-receiving recesses provided on each case part, for connection with the terminals of connectors to be fitted to the box.

When using such electrical connection boxes for different vehicle types, circuit connections of the bus bars are required to be varied according to the respective circuit arrangements of the vehicles.

However, when making the bus bar connections in this type of boxes, the wires have to be connected to the respective tab terminals projecting from the terminal holes of the connectors. For this reason, there is a necessity to fix to the tip of the wire a connection terminal that can be engaged with the tab terminal. This requires complicated work in connection of the wires, and uses a large number of parts.

SUMMARY OF THE INVENTION

An object of the present invention is to provide an electric connection box having bus bars, which allows easy adaptation and choice of the bus bar circuit connections.

According to the invention, there is provided an electrical connection box having connectable upper and lower casing parts defining an interior space when connected. A plurality of bus bars are arranged within the interior space in a side-by-side array with respective main body portions of a sheet form arranged vertically and parallel to each other. The upper casing part has connector regions to receive exterior connector members in use. Each bus bar has a plurality of tab terminals projecting upwardly away from the bus bar main body portion on the upper side thereof and protruding into the connector regions. At least one pressure contact blade projects downwardly from the bus bar main body portion for making pressure contact with an electrical wire.

Preferably, the respective pressure contact blades of the bus bars are arranged in at least one row orthogonal to the direction of the bus bar main body portions, so that in use an electrical wire making contact with the pressure contact blades can extend linearly in the orthogonal direction.

In another aspect, the invention provides a method of making an electrical connection box, including the steps of:

providing connectable upper and lower casing parts defining when connected an interior space, the upper casing part having connector regions to receive exterior connector members in use, inserting into respective predetermined holding locations of one of the casing parts a plurality of bus bars which each have a main body portion of sheet form, the main body portions being arranged vertically and parallel to each other in their inserted locations, the bus bars each having a plurality of tab terminals on the upper side of the bus bar main body portion which protrude into the connector regions in the inserted locations of the bus bars and at least one pressure contact blade projecting downwardly from the bus bar main body portion, before or after the inserting step, establishing electrical connections between the bus bars in a predetermined manner by electrical wires making pressure contact with the pressure contact blades, and connecting the upper and lower casing parts together so as to secure the bus bars and wires in the interior space.

In this specification, including the claims, the directional terms "upper", "lower", "vertically" etc. are used relatively to each other for convenience of explanation and definition and refer to the orientations shown in the figures. However, the connection box of the invention can be assembled and used in any orientation appropriate to a particular assembly process or use.

BRIEF DESCRIPTION OF THE DRAWINGS

Embodiments of the invention will now be described by way of non-limitative example with reference to the accompanying drawings, in which.

DETAILED DESCRIPTION OF THE EMBODIMENTS

One embodiment of the present invention is described in detail below with reference to FIGS. 1 to 6.

Figure 1:
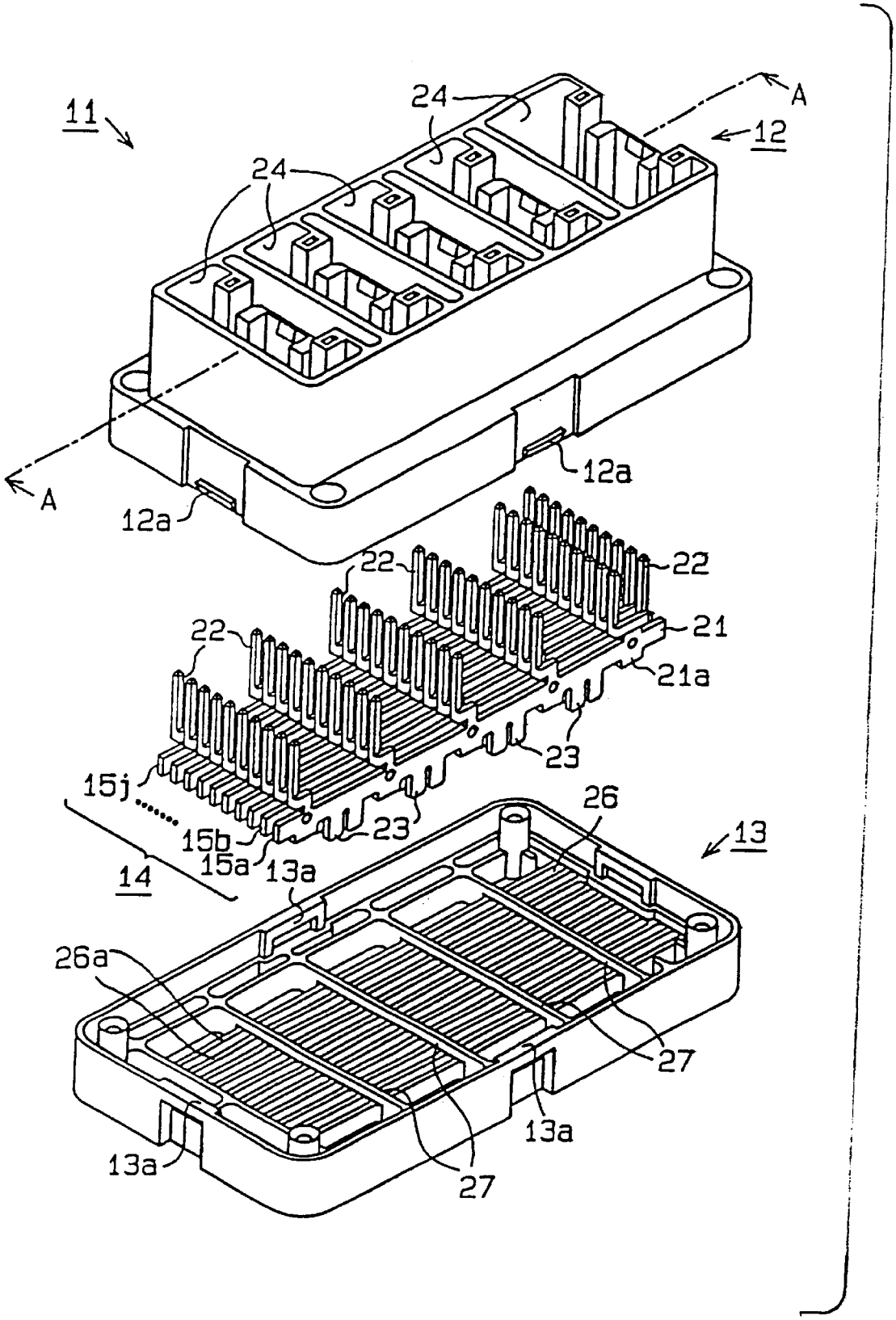
FIG. 1 is an exploded top perspective view of an electrical connection box of one embodiment of the invention.
Figure 2:
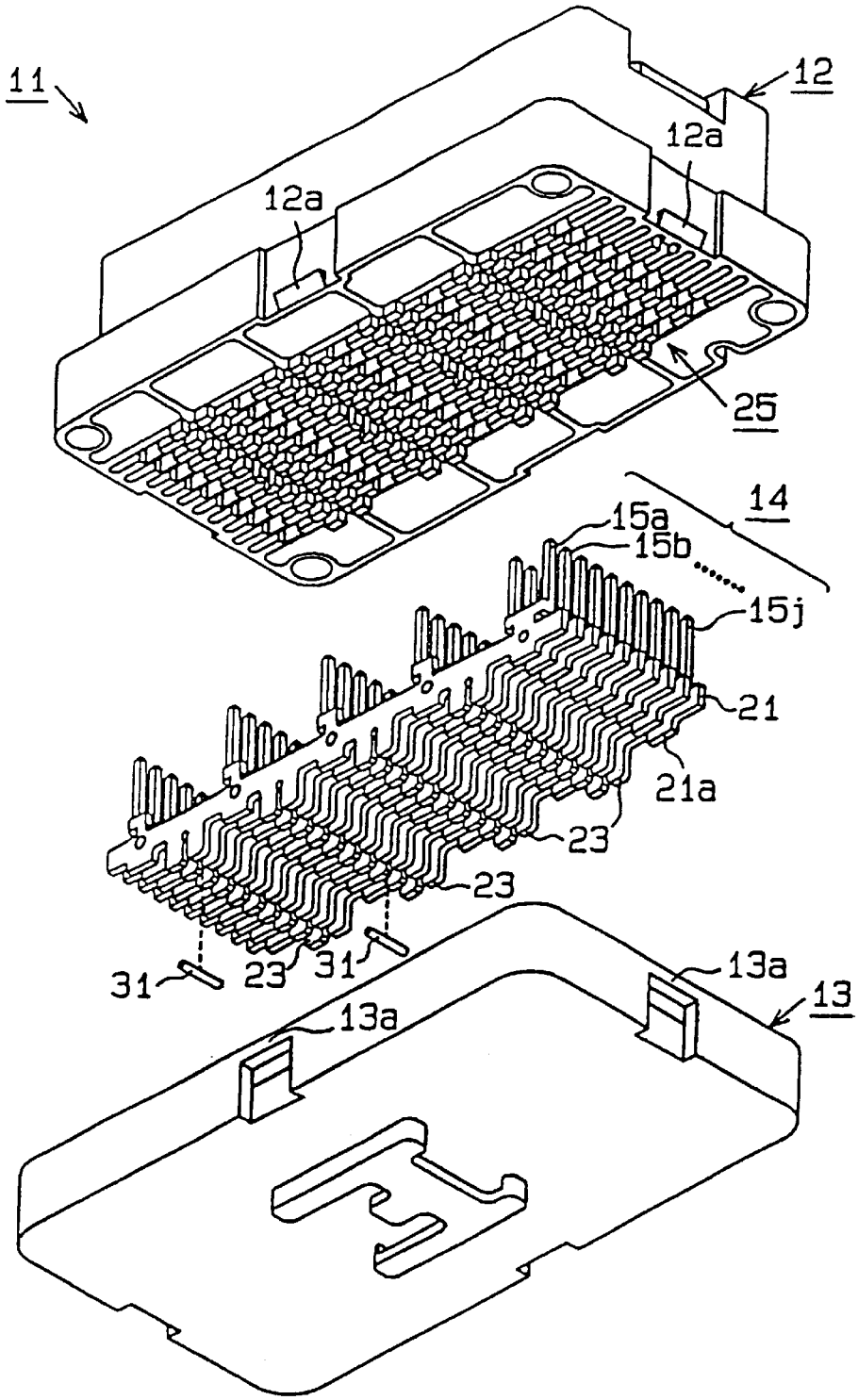
FIG. 2 is an exploded button perspective view of the electrical connection box of FIG. 1.

As shown in FIGS. 1 and 2, the electrical connection box 11 is constituted by an upper casing part, here called upper case 12, a lower casing part, here called lower case 13, and an array 14 of bus bars.

The upper case 12 and the lower case 13 are respectively made, each in one piece, of synthetic resin, and are mutually engageable to connect them together. In detail, on each side of the upper case 12, there are formed first engaging parts 12*a*, and on the inside of the lower case 13 there are formed complementary second engaging parts 13*a* which connect in snap-fit manner with the first engaging parts 12*a*.

The array 14 of bus bars is constituted by ten vertical bus bars 15*a*–15*j*, each formed of a metal sheet as one piece. The respective bus bars 15*a*–15*j* in this embodiment all have the same shape and configuration, and are formed by punching and bending metal sheet. Each bus bar 15*a*–15*j* has a plate-form or sheet-form planar main bus bar body 21, a plurality of tab terminals 22, and a plurality of pressure contact blades 23 which are coplanar with the body 21. The tab terminals 22 project on one side of the bus bar body 21 and are spaced at predetermined regular intervals. The pressure contact blades 23 project on the opposite side, at equal intervals, at locations horizontally offset from the tab terminals 22. The tab terminals 22 and pressure contact blades 23 thus alternate along the bus bar body 21.

On the same side as the pressure contact blades 23 the bus bar body 21 has a plurality of projections 21*a*, at predetermined intervals, whose lower edges are flush with the bottom face of the upper case 12 when the bus bars 15*a*–15*j* are completely inserted in the upper case 12.

On the top face of the upper case 12, there are formed a plurality of connector housings 24, in the form of recesses defined by upstanding walls. These receive exterior connectors in use. Also, as shown in FIGS. 2 and 3, on the bottom face side of the upper case 12, there are bus bar receiving grooves 25 defined by separating walls 25*a*, which accommodate the bus bars 15*a*–15*j* at equal spacings and in parallel.

As shown in FIG. 1, on the upper face of the lower case 13, corresponding to the grooves 25 of the upper case there are bus bar accommodating recesses or grooves 26 defined by separating walls 26*a*. Additionally, on the upper face of the lower case 13, there are a plurality of ribs 27 higher than the walls 26*a* and linearly extending orthogonally to the grooves 26 at predetermined intervals, at the positions corresponding to the projections 21*a* of the bus bars 15*a*–15*j* when installed.

Figure 3:
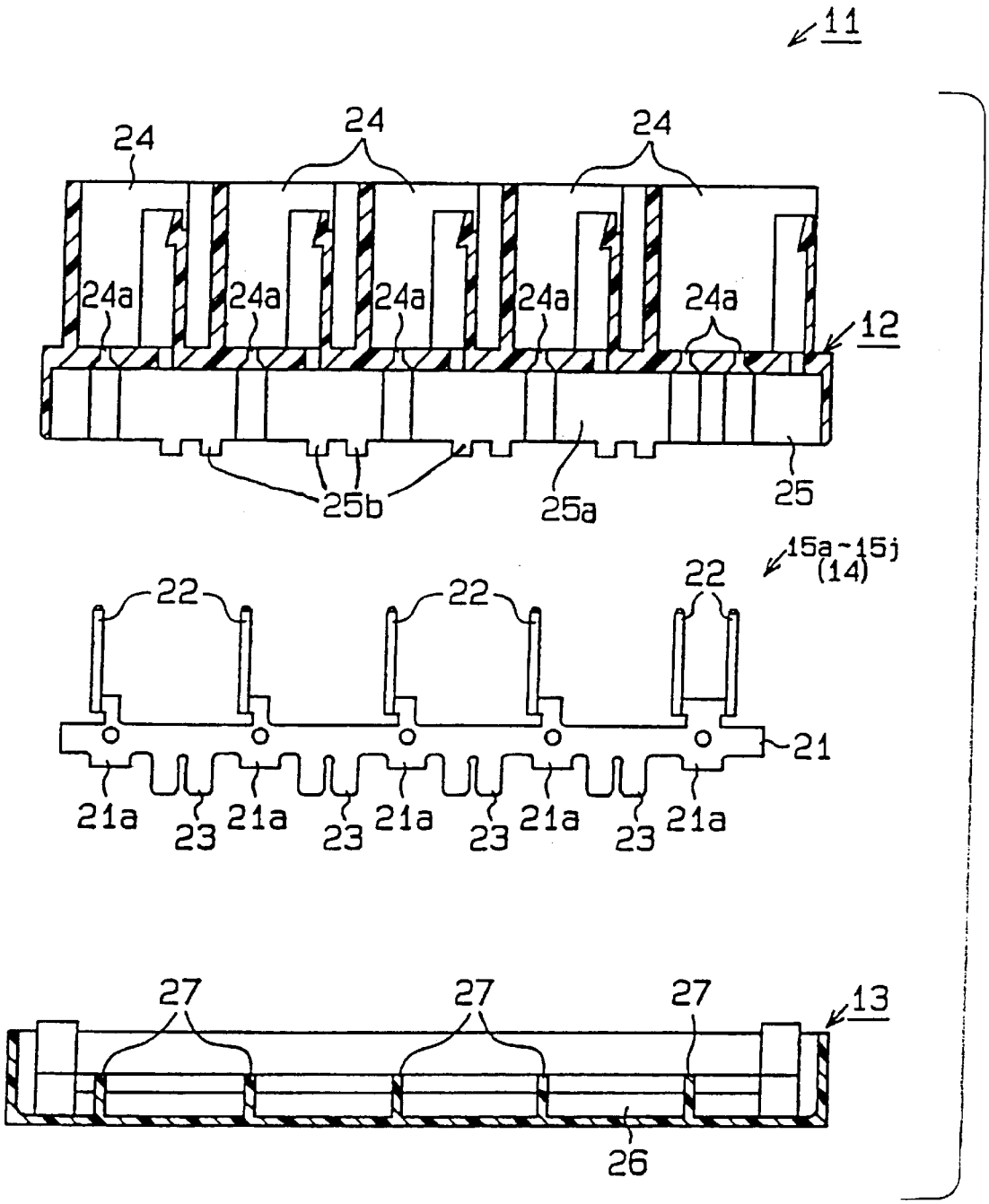
FIG. 3 is a sectional view on the line A—A in FIG. 1.

In the electrical connection box 11, each bus bar 15*a*–15*j* is accommodated upright in a groove 25 with the tab terminals 22 directed upwardly, as shown in FIG. 1 to FIG. 4. As shown in FIG. 3, in the bottom wall of each connector housing 24 there are a plurality of through holes 24*a*, through which the tab terminals 22 are thrust, while the pressure contact blades 23 of the bus bars are arranged in rows in the direction orthogonal to the direction of the bus bar bodies 21.

When each bus bar 15*a*–15*j* is fully received in the groove 25, the lower edge of each projection 21*a* is flush with the bottom face of the upper case 12 (i.e. flush with the lower edges of the walls 25*a* and the lower edge of the peripheral wall of the upper case 12), which enables easy observation that each bus bar is correctly located.

Figure 6:
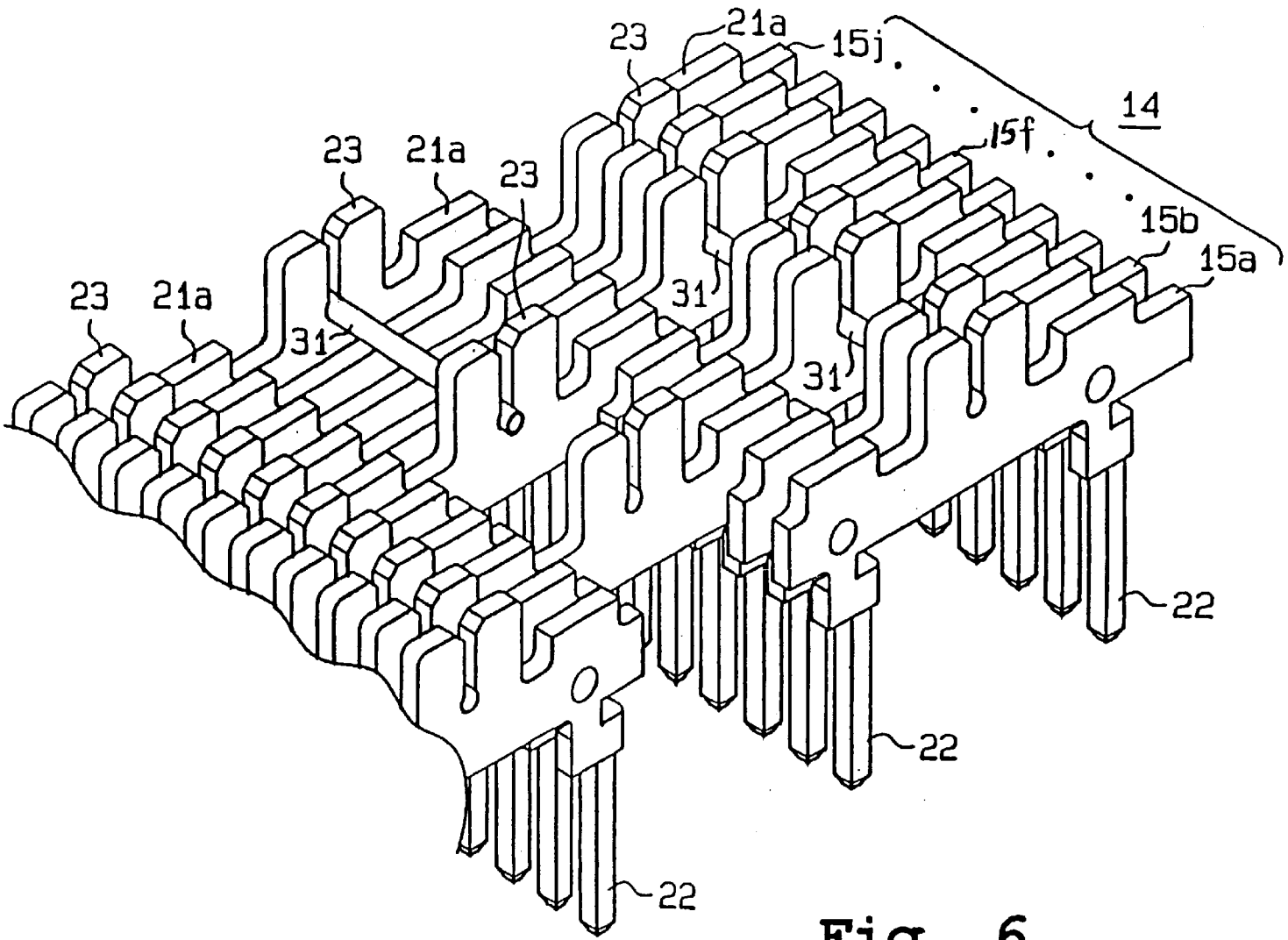
FIG. 6 is a perspective view of an example of modification of the bus bar circuits.

To establish any particular desired arrangement of the bus bar circuits by electrically connecting the different bus bars 15*a*–15*j*, electrical wires 31 are brought into pressure contact with the desired pressure contact blades 23, as shown in FIG. 6. Each wire 31 is, for example, a single core wire. The wires are brought into pressure contact with the desired pressure contact blades 23 by a pressure contact machine (not shown), and pressed into the slots in the blades 23 to fix the wires in position and establish electrical connection. The wires of the desired bus bars 15*a*–15*j* are thus electrically connected. Since the blades 23 are in rows, the wires 31 are laid linearly in the direction orthogonal with the direction of the bus bar bodies 21.

Figure 4:
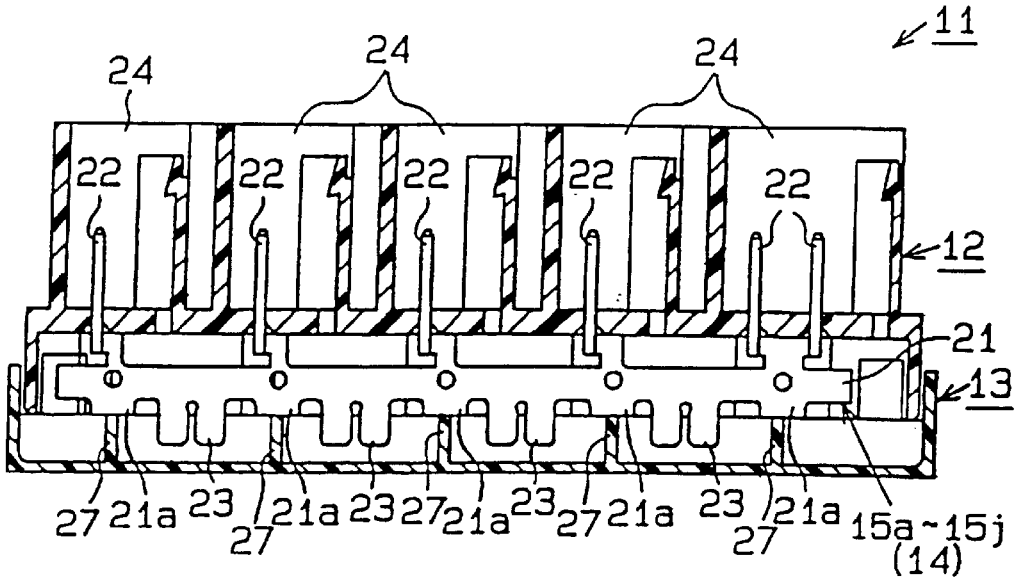
FIG. 4 is the same sectional view as FIG. 3 showing the assembled state of the box.

Thereafter the lower case 13 is fitted to the bottom side of the upper case 12, so that, as shown in FIG. 4, each rib 27 of the lower case 13 comes into direct contact with the rows of projections 21*a* of bus bars 15*a*–15*j*. Thus, if the bus bars 15*a*–15*j* are not fully accommodated in the grooves 25, the projections 21*a* are pressed by the ribs 27 to bring the bus bars 15*a*–15*j* to their correct positions on fitting of the lower case 13. The bus bars 15*a*–15*j* and the wires 31 are now accommodated in the interior space of the electric connection box 11.

FIGS. 2 and 3 show that the separating walls 25*a* have pairs of downward projections 25*b* at the locations of the pressure contact blades 23. The projections 25*b* support the blades 23 laterally, e.g. during the operation of inserting the interconnecting wiles 31. Furthermore, when the lower case 13 is connected to the upper case 12, the lower ends of the pressure contact blades 23 are received in the grooves 26, so that the separating walls 26*a* also act to support the pressure contact blades 23. In this embodiment there are no terminals (such as tab terminals) projecting from the bus bars 15*a*–15*j* through the lower case 13, which therefore acts as a base of the connection box 11, enclosing and protecting the wires 31 and the pressure contact blades 23. The wires 31 and contact blades 23 are thus well protected and supported in position against external forces, e.g. when connectors are pushed onto the tab terminals 22, ensuring high reliability of the internal wiring of the connection box.

By cutting to eliminate selected parts of bus bars 15*a*–15*j*, it is possible to adapt the bus bar circuits to a particular desired arrangement, with wide choice. For example, the bus bar body 21 may be cut to eliminate a portion shown by the broken lines C1 in FIG. 5, to separate the bus bar into two parts which are electrically isolated. Various forms of the bus bars are obtainable as shown, for example, in FIG. 6.

Figure 5:
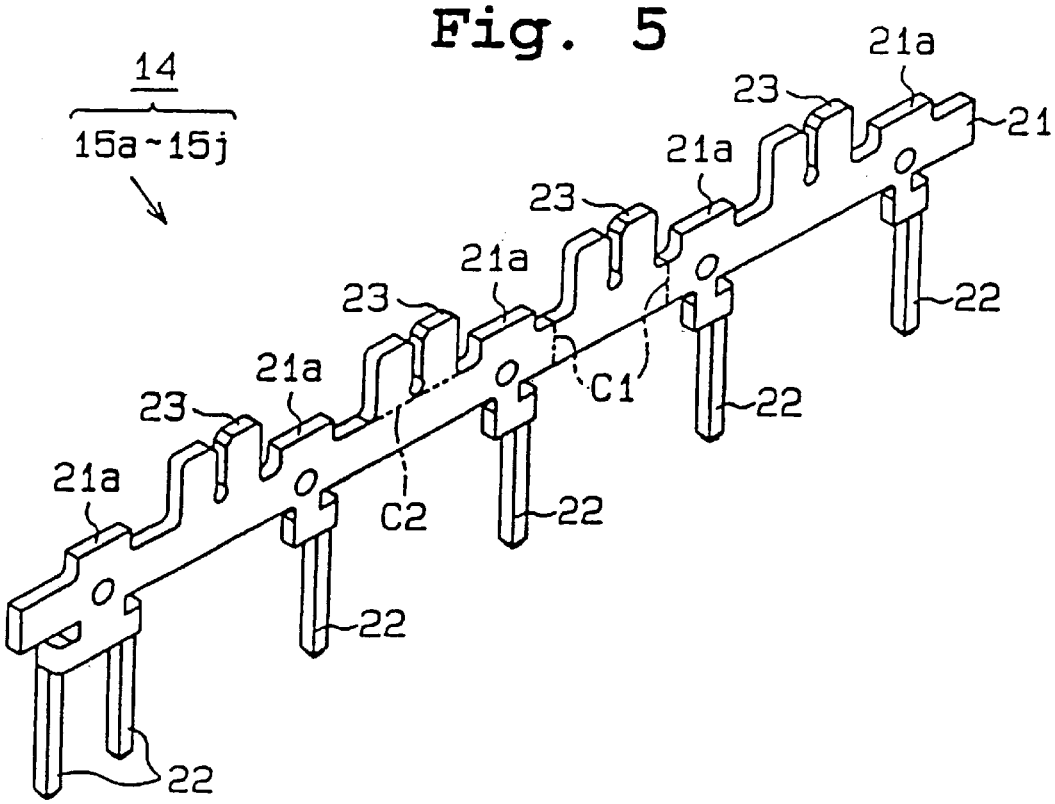
FIG. 5 is a bottom perspective view of a vertical bus bar of the same embodiment.

Furthermore, if it is wanted to make mutual electrical connection between non-adjacent bus bars, for example as shown in FIG. 6 to connect electrically the bus bar 15*f* and the bus bar 15*j*, selected pressure contact blades 23 in one transverse row thereof are cut off to remove them, e.g. by cutting on the line C2 in FIG. 5. A wire 31 is brought into pressure contact with the remaining pressure contact blades 23 of the bus bars 15*f*,15*j*. Various bus bar circuits are thus obtainable as shown, for example, in FIG. 6.

In this embodiment, the following effects can be obtained:

(1) As the bus bars 15*a*–15*j* are provided with the pressure contact blades 23, when an electrical wire 31 is brought into pressure contact with, for example, the pressure contact blades 23 of two adjacent bus bars, the two bus bars can be electrically connected. In other words, there is no necessity as in a conventional electric connection box to fix connection terminals engageable with the tab terminals 22 to the ends of the electric wires 31. Accordingly, it is easy to carry out electrical connection between the different bus bars.

(2) In each of the bus bars 15*a*–15*j*, no tab terminal 22 is provided on the side where the pressure contact blade 23 is provided. Accordingly, even when the tab terminals 22 are in a crowded arrangement, the electrical wire 31 can be easily brought into contact with the pressure contact blade 23.

(3) When the electrical wire 31 is brought into pressure contact with the pressure contact blades 23 of the bus bars 15*a*–15*j*, the wire 31 can have a linear form (straight line). Accordingly, the wire 31 can be reliably brought into contact with the blades 23. Also, in addition, as the bus bars 15*a*–15*j* are accommodated in the grooves 25 in parallel, the position of each pressure contact blade 23 can be easily computed. Therefore, positioning of the wires 31 can be easily done automatically.

Moreover, as a plurality of the blades 23 are formed on each of the bus bars 15*a*–15*j*, the wires 31 can be brought into pressure contact with the desired bus bars 15*a*–15*j* in various modes. The contact blades 23 are at equal distances apart, so that wire positioning by a pressure contact machine can be easily performed.

(4) In the known electrical connection box as described above, because wires in the box cannot be used to make electrical connection between the different bus bars, it is necessary to connect the electric wires to the tab terminals outside the box. Accordingly, when mounting the electrical connection box in a vehicle, the wires become an obstacle. For this reason, space for accommodating the wires is required, and it is necessary to use a large space for mounting the electric connection box in a vehicle. In contrast, in the electrical connection box 11 of this embodiment, the wires 31 are accommodated in the box, and not exposed outside the box. For this reason, there is no requirement for space for the wires 31 in the vehicle, and there is no necessity to use a large space for mounting the electric connection box 11 in the vehicle.

In addition, as the wire 31 is not exposed outside the box, improved waterproof performance is obtained. Moreover, due to no intervention of connection terminals between the wires and the bus bars 15*a*–15*j*, increase of electric contact resistance can be prevented, and reliability can be improved.

Figure 7:
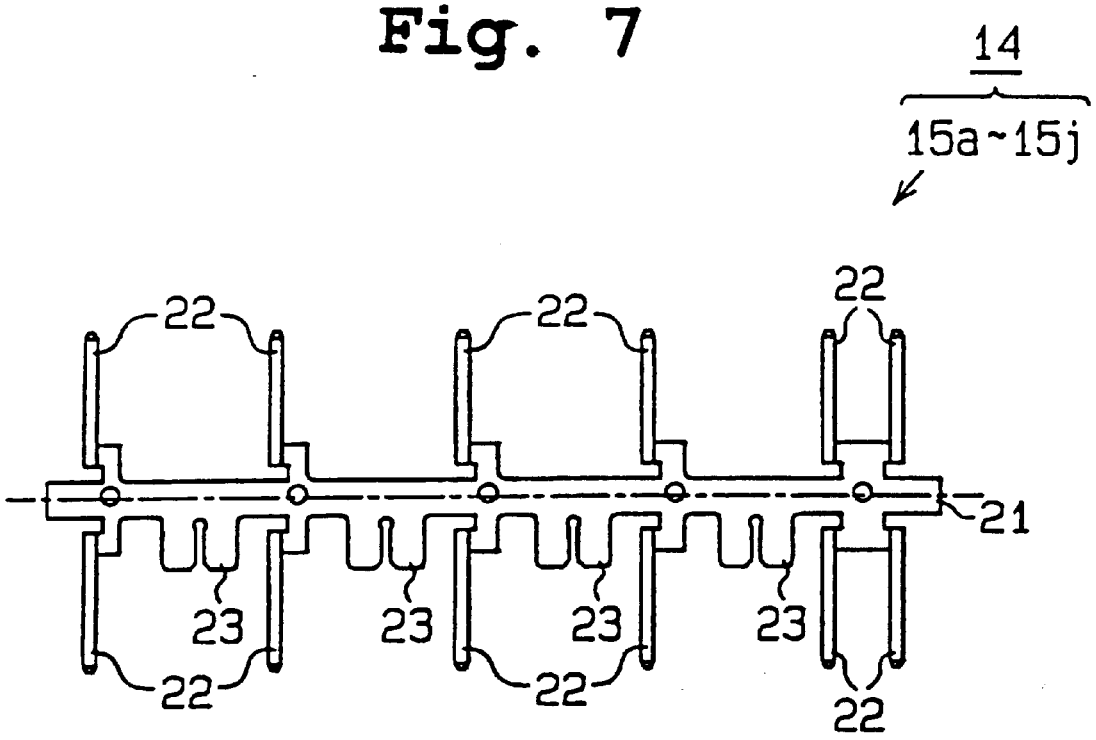
FIG. 7 is a front view of a vertical bus bar of another embodiment of the invention.

The embodiment of the present invention shown may be modified as follows:

In the above embodiment, tab terminals 22 project on only one side of the bus bars 15*a*–15*j*, and the pressure contact blades 23 project on only the other side. However, as shown in FIG. 7, at the side at which the pressure contact blades 23 project, tab terminals 22 may be provided, e.g. to project symmetrically as shown in the figure.

Figure 8:
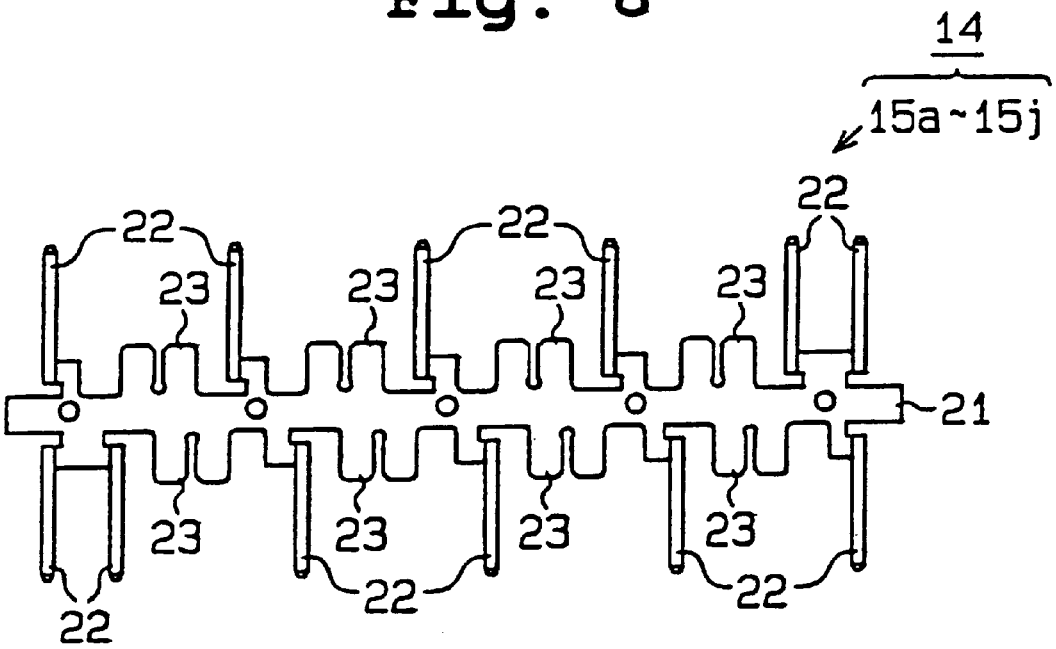
FIG. 8 is a front view of a vertical bus bar of yet another embodiment of the invention.

Also, as shown in FIG. 8, at the side at which the pressure contact blades 23 project, tab terminals 22 may be provided staggered with respect to the terminals 22 at the upper side, and pressure contact blades 23 may be provided on both sides.

With such an arrangement the connector housings 24 may be formed on both the upper case 12 and the lower case 13, so that the number of the connectors fitted to the connection box 11 can be increased. Furthermore, by providing pressure contact blade 23 on both sides of the bus bar body 21, locations for wires 31 can be increased.

The pressure contact blades 23 are arranged in rows orthogonal to the direction of extension of the bus bar body 21, but this is not necessary.

The projections 21*a* provided on the bus bar body 21 may be omitted. In this case, pressure contact blades 23 can be formed in place of the projections 21*a*.

The ribs 27 provided on the top face of the lower case 14 may be omitted. When such provision is made, the lower case 14 can have a simpler construction.

In the foregoing embodiments all the bus bars 15*a*–15*j* are formed with the same configuration. However, these bus bars 15*a*–15*j* may be of mutually different configurations.

In the embodiment of FIGS. 1 to 6, because there is no projection of tab terminals to the side provided with the pressure contact blades, the tab terminals do not become obstacles in making pressure contact of wires with the pressure contact blades. For this reason, the wires can be easily brought into pressure contact with the pressure contact blades.

Furthermore, the wires may extend in straight lines orthogonally to the bus bars. For this reason, the wires can be reliably brought into pressure contact with the pressure contact blades. Moreover, as the bus bars are disposed parallel with one another, the position of each pressure contact blade can be easily computed. Consequently, in carrying out pressure contact of the electric wires automatically using a pressure contact machine, position setting of the electric wires to the individual pressure contact blades can be easily achieved.

In other embodiments, when the connector housings 24 are provided on both the first and the second cases and the tab terminals project on both sides of the bus bar body, the numbers of the connectors attached to the connection box can be increased. Also, when the pressure contact blades are provided on both sides of the bus bar body, the locations of the wires 31 can be increased.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical connection box comprising:

connectable upper and lower casing parts defining an interior space when connected, said upper casing part having connector regions that receive exterior connector members; and a plurality of bus bars arranged within said interior space in a side-by-side array;

said bus bars having respective main body portions of sheet form arranged vertically and parallel to each other; and each said bus bar having a plurality of tab terminals projecting from at least a first edge of said main body portion, said tab terminals projecting from the first edge protruding into said connector regions, and at least one pressure contact blade projecting from at least a second edge of said main body portion for making pressure contact with an electrical wire, said tab terminal and said at least one pressure contact blade being offset from each other.

2. An electrical connection box according to claim 1, wherein respective ones of said pressure contact blades of said bus bars are arranged in at least one row orthogonal to a longitudinal direction of said main body portions.

3. An electrical connection box according to claim 1, wherein each of said bus bars has a plurality of said pressure contact blades spaced apart along said main body portion and coplanar with said main body portion, said pressure contact blades of respective ones of said bus bars being aligned in a plurality of rows orthogonal to a longitudinal direction of said main body portions.

4. An electrical connection box according to claim 1, wherein said upper casing part has a plurality of parallel locating grooves defined by separating walls, in which said bus bars are respectively mounted, said separating walls having downward projections lying adjacent said pressure contact blades and providing support for said pressure contact blades.

5. An electrical connection box according to claim 1, wherein said bus bars have no terminals projecting downwardly through said lower casing part, said lower casing part constituting a base enclosing and protecting said pressure contact blades.

6. An electrical connection box according to claim 1, wherein said lower casing part has recesses which receive and support said pressure contact blades.

7. An electrical connection box according to claim 1, wherein each said bus bar has a plurality of abutment elements, and at least one of said upper and lower casing parts has abutment surfaces that abut and position said abutment elements.

8. An electrical connection box according to claim 1, wherein said connector regions on said upper casing part are recesses defined by upstanding walls on said upper casing part, said recesses being separated at their bottom ends from said interior space by a wall having apertures through which said tab terminals protrude.

9. A method of making an electrical connection box, comprising the steps of:

providing connectable upper and lower casing parts defining when connected an interior space, said upper casing part having connector regions to receive exterior connector members, inserting into respective predetermined holding locations of one of said casing parts a plurality of bus bars which each have a main body portion of sheet form, the main body portions being arranged vertically and parallel to each other in the holding locations, said bus bars each having a plurality of tab terminals on at least a first edge of said main body portion, the tab terminals on the first edge protruding into said connector regions in said holding locations of said bus bars, and at least one pressure contact blade projecting from at least a second edge of said main body portion, said tab terminals and said at least one pressure contact blade being offset from each other, before or after said inserting step, establishing electrical connections between said bus bars in a predetermined manner by electrical wires making pressure contact with said pressure contact blades, and connecting said upper and lower casing parts together so as to secure said bus bars and wires in said interior space.

10. An electrical connection box comprising:

connectable upper and lower casing parts defining an interior space when connected, said upper casing part having connector regions that receive exterior connector members; and a plurality of bus bars arranged within said interior space in a side-by-side array;

said bus bars having respective main body portions of sheet form arranged vertically and parallel to each other; and each said bus bar having a plurality of tab terminals projecting from at least a first edge of said main body portion, said tab terminals projecting from the first edge protruding into said connector regions, and at least one pressure contact blade projecting from at least a second edge of said main body portion for making pressure contact with an electrical wire, wherein said upper casing part has a plurality of pre-existing parallel locating grooves defined by separating walls, in which said bus bars are respectively mounted, said separating walls having downward projections lying adjacent said pressure contact blades and providing support for said pressure contact blades.

11. An electrical connection box comprising:

connectable upper and lower casing parts defining an interior space when connected, said upper casing part having connector regions that receive exterior connector members; and a plurality of bus bars arranged within said interior space in a side-by-side array;

said bus bars having respective main body portions of sheet form arranged vertically and parallel to each other; and each said bus bar having a plurality of tab terminals projecting from at least a first edge of said main body portion, said tab terminals projecting from the first edge protruding into said connector regions, and at least one pressure contact blade projecting from at least a second edge of said main body portion for making pressure contact with an electrical wire, wherein each said bus bar has a plurality of abutment elements, and at least one of said upper and lower casing parts has abutment surfaces that abut and position said abutment elements.

* * * * *